US006158091A

United States Patent [19]

Olbrich et al.

[11] Patent Number: 6,158,091

[45] Date of Patent: Dec. 12, 2000

[54] DRAFTING FRAME FOR A SPINNING MACHINE HAVING A ROVING COMPACTOR

[75] Inventors: Andreas Olbrich, Kirchheim; Stefan Krawietz, Ebersbach; Jürgen Schneider; Jörg Steger, both of Stuttgart; Hermann Güttler, Uhingen, all of Germany

[73] Assignee: Zinser Textilmaschinen GmbH, Ebersbach/Fils, Germany

[21] Appl. No.: 09/390,534

[22] Filed: Sep. 3, 1999

[30] Foreign Application Priority Data

Sep. 8, 1998 [DE] Germany ..... 198 40 960

[51] Int. Cl.[7] ..... D01H 5/60

[52] U.S. Cl. ..... 19/263; 19/236; 19/265; 57/304

[58] Field of Search ..... 19/150, 236–250, 19/252, 257, 262, 263, 264, 286, 287, 288, 304, 305, 306, 307, 308, 265; 57/264, 304, 315, 328, 333; 15/256.51, 256.52, 256.53

[56] References Cited

U.S. PATENT DOCUMENTS

| | | | |
|---|---|---|---|
| 3,141,203 | 7/1964 | Whitehurst et al. | 19/265 |
| 3,251,101 | 5/1966 | Ingham, Jr. | 19/265 |
| 3,802,174 | 4/1974 | Landwehrkamp et al. | 57/315 |
| 3,992,865 | 11/1976 | Tuchida et al. | 57/315 |
| 4,662,167 | 5/1987 | Stahlecker | 57/304 |
| 4,953,349 | 9/1990 | Fehrer | 57/315 |
| 5,090,192 | 2/1992 | Stahlecker | 57/328 |
| 5,305,498 | 4/1994 | Lang | 19/263 |
| 5,600,872 | 2/1997 | Artzt et al. | 19/244 |

FOREIGN PATENT DOCUMENTS

| | | |
|---|---|---|
| 1 251 194 | 9/1961 | Germany . |
| 1 760 832 | 3/1972 | Germany . |
| 43 23 472 | 1/1995 | Germany . |
| 296 00 417 | 3/1996 | Germany . |

*Primary Examiner*—John J. Calvert
*Assistant Examiner*—Gary L. Welch
*Attorney, Agent, or Firm*—Herbert Dubno

[57] ABSTRACT

A drafting frame is provided with at least one compaction unit in which a belt with a perforation under suction serves to draw together the fibers of a drafted roving. The belt is juxtaposed with a stripper spaced from the belt to remove fiber accommodations thereon. The gap between the stripper edge and the belt is adjustable.

6 Claims, 4 Drawing Sheets

DRAFTING FRAME FOR A SPINNING MACHINE HAVING A ROVING COMPACTOR

FIELD OF THE INVENTION

Our present invention relates to a drafting frame for a machine for processing a roving, e.g. a roving frame or spinning machine, (especially a ring-spinning machine wherein the drafting frame has at least at its output a compacting unit which can subject the previously drafted roving or band to compaction before the roving is fed to the roving frame.

The compaction unit may be an endless belt formed downstream of the last of the drafting members of the series of codirectionally moving surfaces (rollers or belts) which are spaced apart along the path of the roving and which are driven at progressively increased peripheral speeds to draft the roving. When such a belt is used as a compaction unit, it may be provided with a perforation, e.g. a row of orifices extending along the path of the roving or a slit and under suction so that the fibers of the drafted roving or fiber band are drawn together and thereby compacted as they pass between this belt and a surface of another belt or roller moving in the same direction. The belt may enclose a suction chamber which is maintained under subatmospheric pressure.

BACKGROUND OF THE INVENTION

An apparatus of the aforedescribed general type is disclosed, for example, in German Patent Documents DE 43 23 472 C2 and DE 296 00 417 U1. In such systems in the case of breakage of the fiber strand along the drafting frame or upstream of the drafting frame, the liberated fibers are drawn off by suction and some turns can wind up on the endless belt and accumulate thereon. Such winding up onto the last belt may be induced by the suction applied through the perforations or slit thereof which communicates the suction to the roving.

It has been proposed to provide a cleaning roll adjacent the belt so as to wipe accumulating fibers from the belt surface. Such a wiping roller may have a felt or other pile surface and hence the wiped off fibers can collect on this roller and require a removal or replacement of the roller from time to time.

If the fibers do collect on the compaction belt, the accumulation thereon may damage the drafting frame at the station at which the roving may be supplied and at adjacent stations, can interfere with proper roving feed to the spinning stations and may otherwise be detrimental to the spinning operation. Indeed, it can cause breakage of neighboring spun threads.

The efforts to use a cleaning roller in the manner described have also been fraught with problems since the cleaning roller must be mounted proximal to the belt and frequently the bearing systems for such rollers have been bulky and not readily accommodatable to the spinning frame. Frequent maintenance is also required to clear or replace such cleaning rollers.

Mention may be made, moreover, of German Patent Document 1,760,832 which has a cleaning device in which a cleaning edge is provided along a roller and along a belt for removing collected fiber in conjunction with a drafting frame. This system does not operate fully satisfactorily, although it does provide two or more edges on a common support and hence simplified mounting of the cleaning system.

Another arrangement deserving of mention is that found in German Published Application 1 251 194 wherein weighted strippers are pivotally mounted above the upper drafting members and carry stripping edges which engage the rollers or belts of the drafting frame and are disposed in a suction duct enabling fibers scraped off from the belt or roller to be evacuated away from the stripper.

In the system of DE 17 60 832 A1, the belt stripper engages directly a straight portion of the belt whereas in DE 1 251 194, a stripper rests directly against the belt. As a consequence, while strippers are provided in these systems, not in conjunction with roving compaction device in accordance with the principles described, the stripping systems tend to increase the frictional resistance to belt movement and that has been found to be detrimental to the efficient operation of the drafting frame and a roving spinning machine embodying same.

OBJECTS OF THE INVENTION

It is, therefore, the principal object of the present invention to provide a drafting frame with at least one roving compaction unit whereby the aforedescribed drawbacks are avoided and high quality thread can be produced at high efficiency.

Another object of the invention is to provide a roving frame in which detrimental aspects of fiber accumulation on a compaction belt, excessive friction of the roving belt and the need for repeated replacement of cleaning rollers can all be obviated.

SUMMARY OF THE INVENTION

These objects and others which will become apparent hereinafter are attained, in accordance with the invention in a drafting frame for a spinning machine which comprises:

- a succession of pairs of juxtaposed members having surfaces moving codirectionally and at speeds such as to draft a roving between the surfaces of the juxtaposed members, and an endless belt provided with perforation means for communicating between a suction chamber bounded by the belt and the roving and subjecting fibers of the drafted fiber band or strand to suction for compacting the strand;
- a stripper having a stripping edge extending a full width of the belt and juxtaposed with the belt over a convex portion thereof across a gap, for stripping fibers accumulating on the belt from the belt; and
- a suction device having a mouth proximal to the stripper for evacuating away fibers stripped from the belt.

According to a feature of the invention, the stripping edge is formed by flanks adjoining (converging) at an acute angle. The perforation means, which can be a continuous slit or a number of spaced apart perforations, e.g. a row of orifices, can be juxtaposed with a portion of the stripping edge which is formed with a recess in the region of the perforations, i.e. is set back, the remainder of the stripping edge approaching the surface of the belt quite closely on either side of this recess.

As will be noted below, an essential feature of the invention is the maintenance of a gap between the stripping edge and the belt surface with which it is juxtaposed so that there is no friction of the stripping edge against that belt surface.

However, the gap may be relatively small, ranging from a fraction of a millimeter (say 0.2 mm) to several millimeters (say 4 mm).

According to another feature of the invention, means is provided for adjusting the spacing between the edge and the belt. That means can include means for mounting the stripper for swing movement for swinging movement relative to the belt. The suction device itself is constructed so that its suction is effective over the entire length of the stripping edge.

With the system of the invention, while there may be an initial accumulation of fiber on the belt, the growth of coils of the fiber on the belt is precluded by the stripping operation and the migration of fiber accumulations to effect other spindles of the spinning machine can be completely precluded. The acute angle shape of the edge enables it to form a cutting edge or blade which ensures shaving of the fiber accumulation from the belt without frictionally providing a drag therein. The suction device can be connected to the suction source for the compaction units and can have a mouth positioned so that it is effective over the entire length of the stripping edge although a separate suction source can be provided for the stripper suction heads. Because of the spacing of the stripper from the belt, damage to the belt at the perforations by the stripper can be avoided.

It is of special importance that the stripper act at a convex part of the path of the belt and preferably at a narrow or small radius portion wherein the belt is guided over a deflecting rail. When such a deflecting rail is not provided, the stripper can be juxtaposed with that part of the belt running around the drum which drives the belt.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
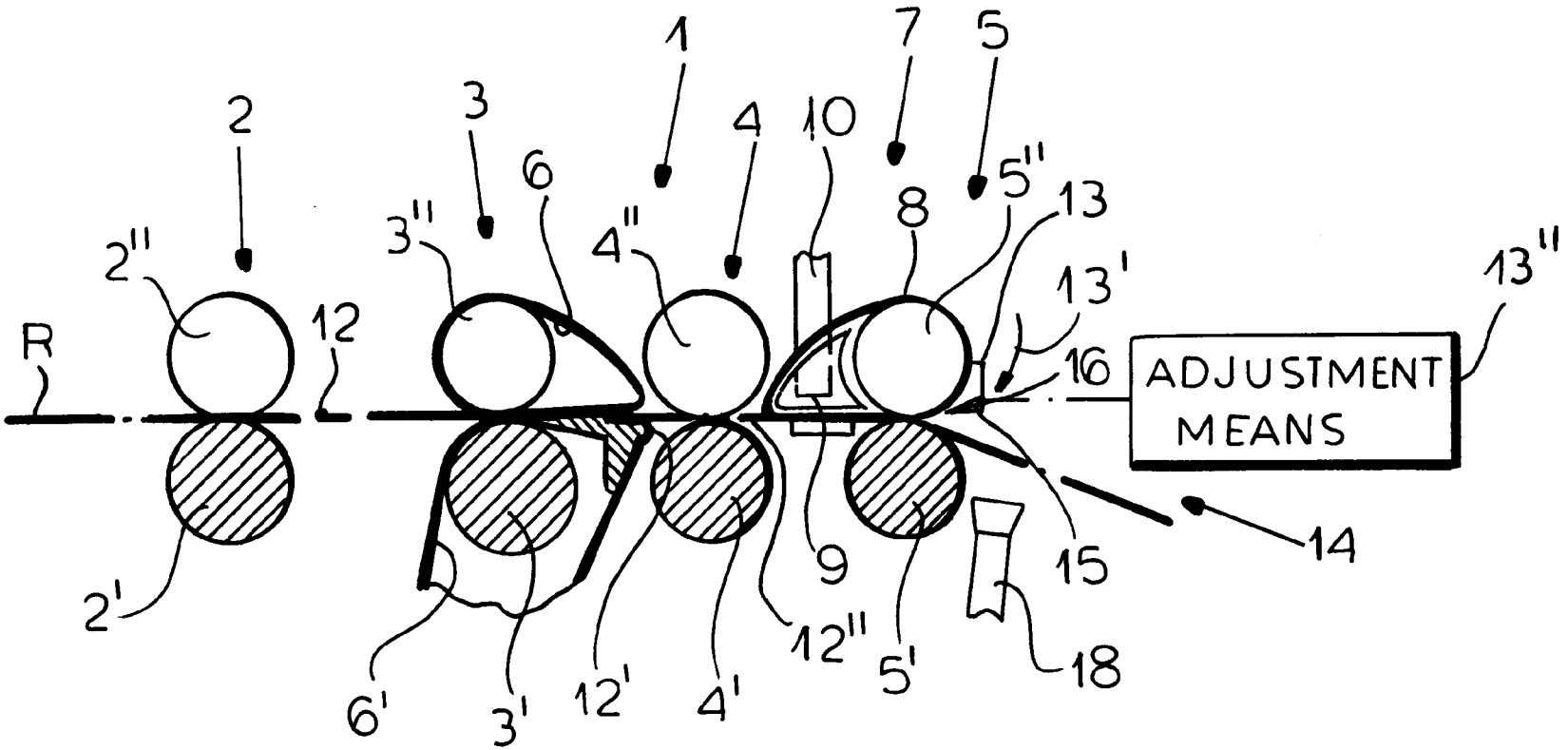
FIG. 1 is a cross sectional view through a drafting frame according to the invention.
Figure 1A:
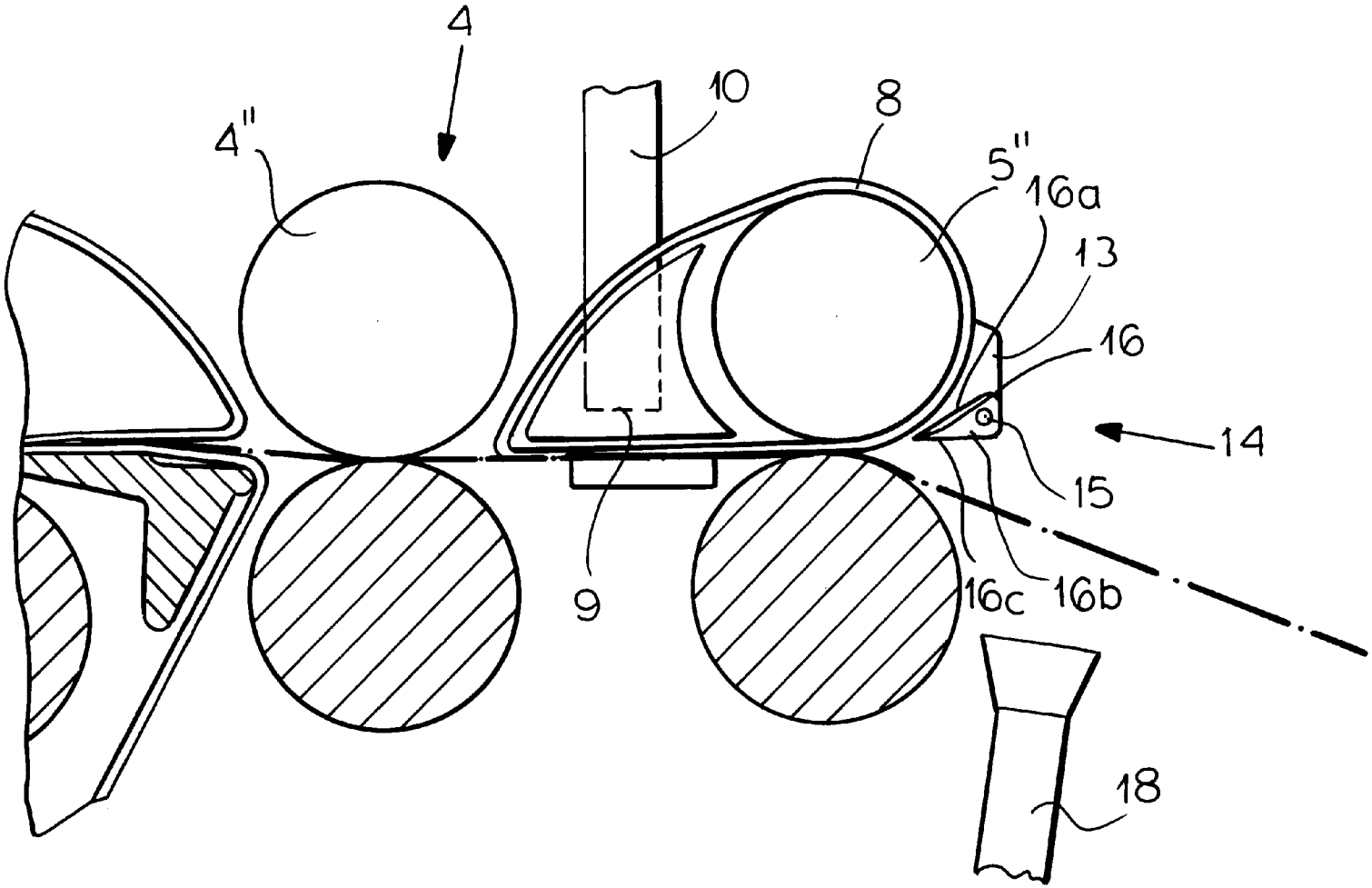
FIG. 1A is a detail of FIG. 1.

As can be seen from FIGS. 1 and 1A, a drafting frame 1 which can be supplied with roving R comprises four roller pairs 2, 3, 4 and 5 in succession. The rollers 2', 3', 4' 5' of these roller pairs form the lower rollers and may be continuous over the length of a roving frame or spinning machine and can be driven at their ends at progressively higher speeds to apply the drafting action to respective rovings R to be fed to respective spindles at respective stations of the spinning frame.

The upper rollers 2", 3", 4" and 5" may be carried in arms (not shown) which can be raised and lowered and which are weighted to press the roving against the lower rollers as is conventional in drafting frames. Between the roller pairs 2 and 3, a predrafting stretch 12 can be provided while between the roller pairs 3 and 4, a main drafting stretch 12' can be maintained. The rollers 3' and 3" are encircled by respective belts 6' and 6 which have appropriate guides and which form the surfaces between which the roving R or the drafted strand or fiber band passes. A further zone 12" can be provided between the roller pairs 4 and 5 and the output roller pair 5 may form a compaction unit. In the compacting zone 12" there is no drafting of the band. Generically a compaction unit at the end of the drafting frame is represented at 7.

The term compaction unit is here used to describe a unit in which stray fibers and filaments are drawn toward the center of the roving so that the number of fibers or filaments which project from the roving per unit length is substantially reduced. A compaction unit can comprise a perforation means along a line communicating between a suction chamber and the roving and formed by a row of perforations or a slit. As shown in the drawing, the output roller pair 5 forms just such a compaction unit 7 which comprises a compaction belt 8 which surrounds and delimits a suction chamber 9. The suction chamber 9 is connected by piping or a hose 10 with a suction source not shown. At the compaction unit drafting does not occur.

Figure 3:
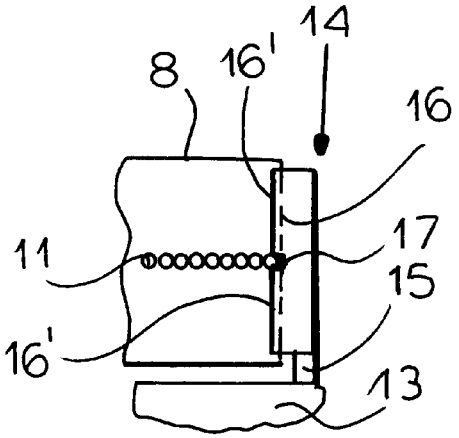
FIG. 3 is a detail view of the stripping unit as seen from below.

The compaction belt 8 is provided centrally with a row of perforations 11 forming the perforation means (see FIG. 3), these perforations or orifices are under suction from the reduced pressure in chamber 9 and draw fibers which tend to project laterally from the roving toward the center of the roving to compact the latter.

A cage 13 which is not shown in detail is mounted to be swingable about an arrow 13' and carries a stripping edge 16 defined between flanks 16*a*, 16*b* at an acute angle 16*c* to one another and adjustable by a screw or a servomechanism represented at 13*n* and forming adjustment means. The cage and stripping blade form a stripper unit represented at 14, the blade itself being carried by a pin 15 which is swingable as represented by the arrow 13' previously mentioned.

The stripping edge 16 extends the full length of the roller 5" and hence substantially the full width of the belt 8 and is spaced from the belt by a slit gap which is difficult to discern in the drawing because of the scale used. That gap is adjustable by the means 13". In addition, in the region of the perforations 11, a cut-out 17 can be provided in the stripping edge 16 so that edge portions 16' approach but are spaced from the belt to either side of that recess as shown at 16' in FIG. 3, by the gap.

Figure 2:
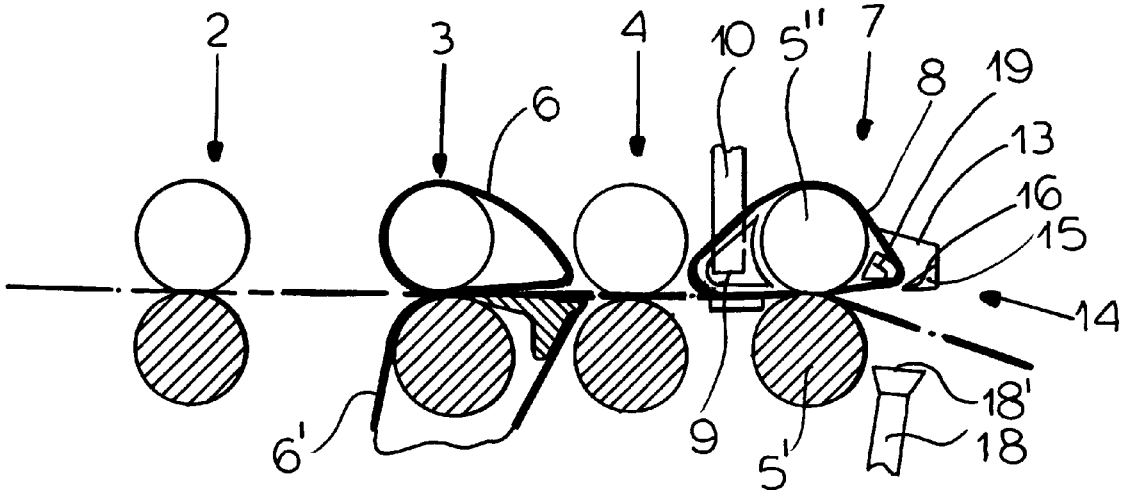
FIG. 2 is a view similar to FIG. 1 through a drafting frame in accordance with the invention.
Figure 2A:
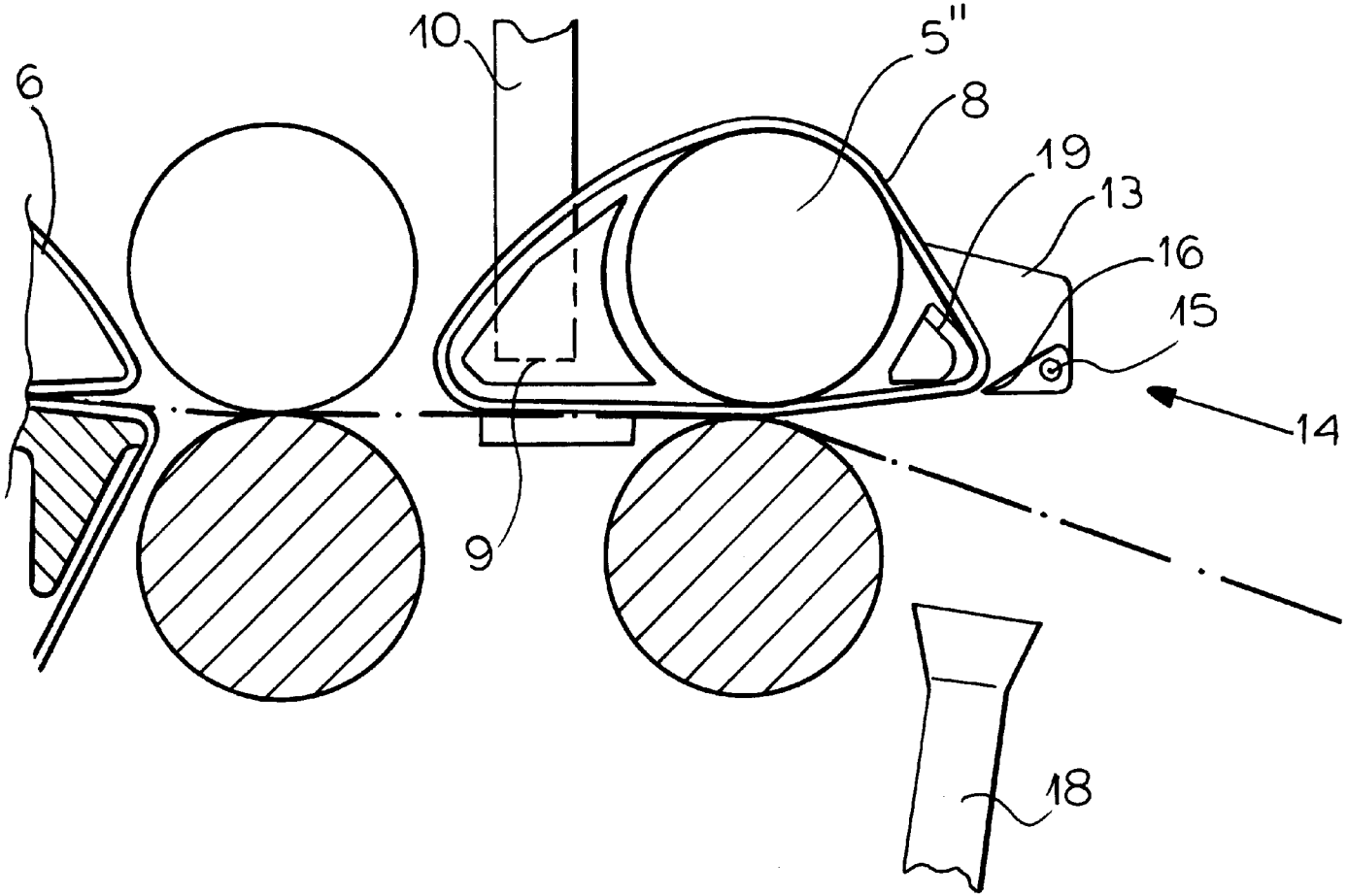
FIG. 2A is a detail of FIG. 2.

A suction pipe 18 has a mouth 18' which also can extend the full length of the roller 5" and the full width of the belt 8 to collect lint and fiber which are stripped by the edge 16 from the belt. The mouth 18' is thus effective so that its suction can collect all of the lint which is removed by the strippers 14 from the respective belts. The embodiment of FIGS. 2 and 2A differs from that of FIG. 1 only in that the compaction belt 8 is also guided downstream of the roller 5" by a rail 19 and has a small radius deflection at which the stripping blade 16 approaches the belt. The fact that the blade is effective in a region in which the belt is convexly curved promotes the stripping effect and that effect is further promoted by guiding the belt over a guide rail of a reduced radius of curvature in the region in which the stripper is provided.

We claim:

1. A drafting frame for a spinning machine, comprising:

a succession of pairs of juxtaposed members having surfaces moving codirectionally and at speeds such as to draft a roving between the surfaces of the juxtaposed members, at least one of said surfaces being formed by an endless belt provided with perforation means for communicating between a suction chamber bounded by said belt and said roving and subjecting fibers of said roving to suction for compacting said roving, said belt having a convex portion in a path of the belt around said chamber;

a stripper having a stripping edge extending a full width of said belt and juxtaposed with said belt but spaced therefrom at said convex portion of said belt across a gap, for stripping fibers accumulating on said belt from said belt whereby said stripping edge is formed with a recess in a region of said perforation means or extends in spaced relation to said belt over the entire width thereof; and a suction device having a mouth proximal to said stripper for evacuating away fibers stripped from said belt.

2. The drafting frame defined in claim 1 wherein said stripping edge is formed by flanks adjoining at an acute angle defined between said flanks.

3. The drafting frame defined in claim 1 wherein said belt is guided around a deflecting rail at said convex portion.

4. The drafting frame defined in claim 1, further comprising means for adjusting a spacing between said edge and said belt.

5. The drafting frame defined in claim 1 wherein said stripper is mounted for swinging movement relative to said belt.

6. The drafting frame defined in claim 1 wherein said suction device is effective over an entire length of said edge.

* * * * *